United States Patent [19]

Takeuchi et al.

[11] Patent Number: 4,499,827

[45] Date of Patent: Feb. 19, 1985

[54] SYSTEM FOR AUTOMATICALLY REMOVING DUST FROM PLATE CYLINDERS OF PRINTING PRESS

[75] Inventors: Hideo Takeuchi, Shiroi; Toshihisa Kaneko; Satoshi Ikeda, both of Tokyo, all of Japan

[73] Assignee: Dai Nippon Insatsu Kabushiki Kaisha, Tokyo, Japan

[21] Appl. No.: 590,205

[22] Filed: Mar. 15, 1984

[30] Foreign Application Priority Data

Mar. 22, 1983 [JP] Japan ..... 58-40884
Mar. 22, 1983 [JP] Japan ..... 58-47687

[51] Int. Cl.[3] ..... B41F 35/02; B41L 41/02

[52] U.S. Cl. ..... 101/425; 15/256.53; 101/141; 364/167

[58] Field of Search ..... 101/423, 424, 425, 141; 15/256.51, 256.52, 256.53; 400/695, 700; 364/167, 519

[56] References Cited

U.S. PATENT DOCUMENTS 3,740,789 6/1973 Ticknor ..... 15/256.53
3,983,813 10/1976 Tani ..... 101/425
3,999,239 12/1976 Misuna ..... 15/256.52

FOREIGN PATENT DOCUMENTS 2535199 2/1977 Fed. Rep. of Germany ..... 101/423
2044133 10/1980 United Kingdom ..... 15/256.53

OTHER PUBLICATIONS

Berlier, "Self-Aligning Roll Scraper", Jul. 1975, IBM Technical Disclosure Bulletin, vol. 18, No. 2, p. 326.

*Primary Examiner*—Clyde I. Coughenour
*Assistant Examiner*—William L. Klima
*Attorney, Agent, or Firm*—Koda and Androlia

[57] ABSTRACT

A system for automatically removing dust from a plate cylinder of a printing press has a laminated structure for inputting a dust removal position, which comprises (a) a printed circuit substrate bearing thereon a reference signal input circuit of comb form with numerous comb conductors and position signal read-out circuits alternatively interposed respectively between adjacent pairs of comb conductors and (b) a pressure-activated conductor sheet superposed in laminated state on and over the circuit substrate. When a printed material having a printing defect due to dust on the printing plate is laid over with correct register on this laminated structure, and the part of the defect is pressed, the nearest conductors of the input circuit and of the read-out circuit are shorted to designate the position of the defect. The resulting signal is processed and is sent to a dust removing mechanism to move a disk-shaped elastic dust removing head to the corresponding dust existing part of the printing plate. The head is revolvable through small increments of angle to present new dust removing parts of its periphery for each dust removing action.

8 Claims, 9 Drawing Figures

SYSTEM FOR AUTOMATICALLY REMOVING DUST FROM PLATE CYLINDERS OF PRINTING PRESS

BACKGROUND OF THE INVENTION

This invention relates to systems and devices for removing foreign matter such as dust from the printing surfaces of plate cylinders of printing presses. More particularly, the invention relates to a system for automatically removing foreign matter such an ink refuse and paper dust (hereinafter referred to collectively as "dust") which has adhered to plate printing surfaces in a printing press during offset printing.

During offset printing, dust adheres to the plate cylinder surfaces and causes white unprinted parts (sometimes called "hickies") resembling pinholes or pimples to be left on the printed material. Heretofore, it has been a common practice for the operator, upon detecting such defects on a proof, to stop the printing press and manually remove the dust. Alternatively, although this is a very dangerous procedure, the operator removes the dust on the rotating plate cylinder surface by means of a rodlike dust removing tool having a tip made of a material such as a rubber material. These dust reremoving procedures, however, respectively give rise to a drop in printing rate and danger to the operator. Accordingly, partially automated systems and devices for dust removal have been proposed.

In one such proposed system, when the operator discovers an unprinted part or hicky on a proof of printer material, he specifically determines the position of the defect relative to a number previously designated in the width direction of the plate cylinder and presses a button at a corresponding position of a control panel thereby to cause a dust removing device installed in confronting relation to the plate cylinder surface to operate. This dust removing device comprises a dust removing head mechanism having at its tip a blade-shaped elastic member, which is caused to contact and wipe the plate cylinder surface during operation, and a shifting mechanism for causing the head mechanism to move to the specified position of the plate cylinder surface. This system, however, has not as yet been reduced to practice because it has the shortcomings described below.

The method of specifying the position of that part of the plate cylinder surface from which dust is to be removed is inaccurate, whereby the dust cannot be positively removed. As described above, the operator determines, by examining the printed proof, the position of the part to be cleaned of dust in correspondence with a number in the width direction of the plate cylinder surface and thereafter pushes what he judges as the appropriate button on the control panel. However, in the case where the unprinted portion is at the central part of the printed material, there is a possibility of an error in the button pressing procedure since the operator judges the button position by eye.

In order to solve this problem, a dust removing device in which the dust removing head mechanism is adapted to carry out scrubbing action has been proposed, but this innovation entails a loss in dust removal time and has not become a practical solution.

The blade-shaped elastic member of the head mechanism also presents a problem. Since it directly contacts and wipes the plate cylinder surface, ink and other matter adhere to the tip part thereof. As a consequence of a number of dust removing operations, the ink accumulated on the blade tip adheres in reverse to the plate cylinder surface and contaminates it. If this ink is left as it is for a number of hours, it will solidify and give rise to trouble such as damage to the plate cylinder and related parts. Accordingly it is necessary for the operator to promptly clean off this ink. This cleaning work is a troublesome burden on the operator.

For this reason, a device for spraying a cleaning agent through a spray nozzle against the blade tip part thereby to automatically clean the same when the dust removing device is in its idle, standby state has been proposed. However, even with this device, it is difficult to achieve thorough cleaning, whereby it has not yet become a practical solution to the problem.

SUMMARY OF THE INVENTION

In view of the above described difficulties arising from the dust problem, it is an object of this invention to provide a system for automatically removing dust on the plate cylinder surfaces of a printing press which system is capable of readily, accurately, and positively designating the position of dust adhering to a plate cylinder surface.

In the use of the system according to this invention, by merely pressing an unprinted spot on a printed material proof directly with a pen-like pressing tool, the exact position for dust removal on the surface of the corresponding printing press plate cylinder is accurately and positively designated, and a dust removing device operates accordingly.

According to this invention, briefly summarized, there is provided a system for automatically removing dust from a plate cylinder of a printing press comprising: a dust removing head mounted for displacement relative to and along the surface of a plate cylinder in the axial direction thereof of the printing press; means for causing the dust removing head to advance toward and retract from the plate cylinder; head moving means for causing the dust removing head to undergo said displacement to a position confronting any position on the plate cylinder surface; dust removal position inputting means having a surface on which a printed material is laid and having means which operates, when the position of a printing defect on the printed material due to dust on the plate cylinder is pressed against said surface, to generate and transmit a position data signal corresponding to the position thus pressed with respect to the direction of the printed material corresponding to the axial direction of the plate cylinder; and operationally processing means for converting said position data signal from the dust removal position inputting means into data for so controlling the head moving device that it moves the dust removing head to the position along the plate cylinder corresponding to said position of the defect pressed against said surface.

The dust removing head may be in the form of a disk-shaped member which is adapted and powered to revolve intermittently through small angular increments so that different parts of the outer periphery thereof are caused to successively confront and contact the plate surface, whereby even if ink accumulates on its tip as a consequence of dust removal work, the head is not subject to the aforedescribed problem and does not require prompt cleaning.

The nature, utility, and further features of this invention will be more clearly apparent from the following detailed description with respect to preferred embodiments of the invention when read in conjunction with the accompanying drawings briefly described below.

DETAILED DESCRIPTION OF THE INVENTION

Figure 1:
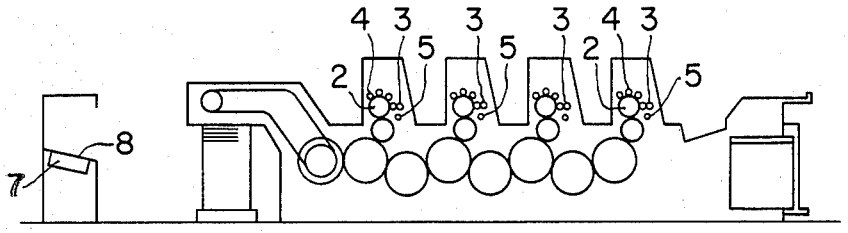
FIG. 1 is a simplified side elevation indicating the mechanical relation of the system of this invention for automatically removing dust from plate cylinder surfaces to a printing press in which the system is installed.

Referring first to FIG. 1, the roll-fed offset printing press shown therein, as is known, has a plurality of plate cylinders 2, 2, . . . in successive positions in the printing operation flow direction. Each plate cylinder 2 is provided with a dampening device 3 in contact therewith and an ink roller 4. The dust removing mechanism constituting an essential part of the system for automatically removing dust from plate cylinder surfaces according to this invention is provided in close proximity to the plate cylinder 2, for example, below the dampening device 3 as designated by reference numeral 5 in FIG. 1. A device 7 for inputting dust removal positions, which imparts designations of dust removal positions to the dust removing mechanism 5 can be installed below a color examining table 8.

It is to be noted that, instead of installing the dust removing mechanism 5 in front (as viewed in FIG. 1) of the dampening device 3 with respect to the rotating direction of the plate cylinder 2, it may be installed between the dampening device 3 and the ink roller 4. Furthermore, the position inputting device 7 need not be installed within or near the color examining table 8 but may be installed separately therefrom.

Figure 2:
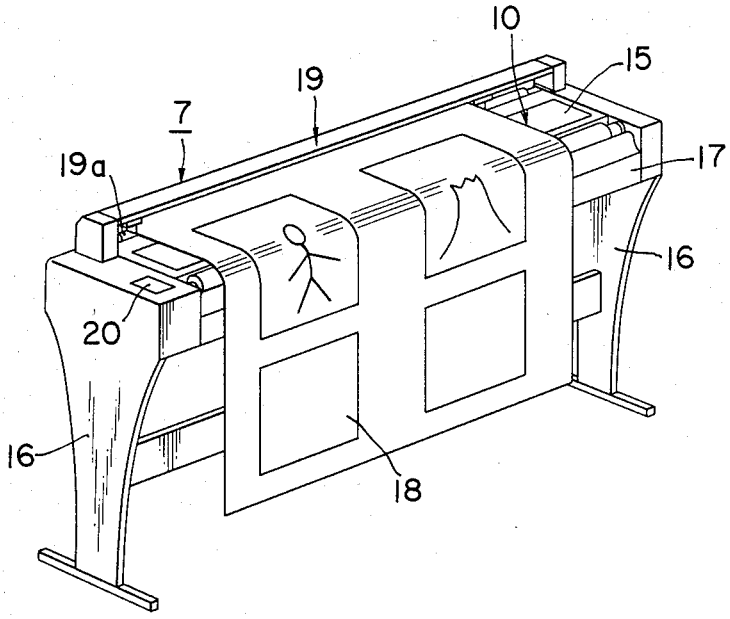
FIG. 2 is a perspective view of a device for inputting dust removal positions.

The exterior appearance of one example of the dust removal position inputting device 7 as a whole is as shown in FIG. 2. This position inputting device 7 has a position inputting part 10 for use by the operator to designate the dust removal position and a computerized circuit adapted to detect the dust removal position, to carry out a logical operation, to display the result, and to control the travel of the dust removing head, described hereinafter, of the dust removing mechanism 5 to the designated position and the dust removing operation.

Figure 3:
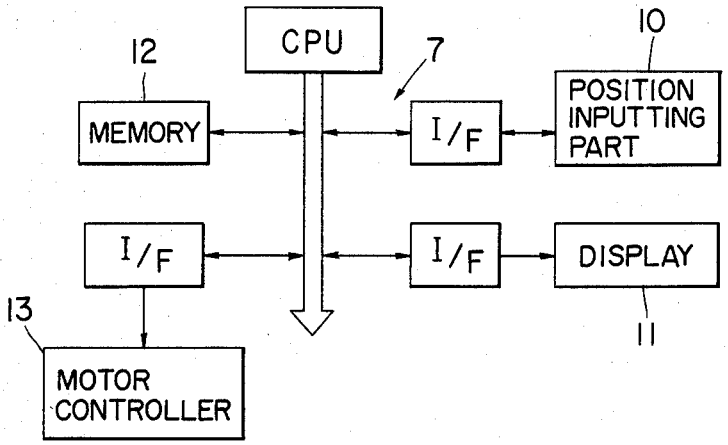
FIG. 3 is a block diagram indicating the essential components and their organization of the electronic system of the dust removal position inputting device and its relating devices.

The dust removal position inputting device 7, as shown in FIG. 3, has a central processing unit CPU constituting an operationally processing device, the above mentioned position inputting part 10, a display part 11, a memory 12, and a motor controller 13 as essential components. Dust removal position input data from the position inputting part 10 is introduced as input via an interface I/F into the central processing unit CPU, where it is operationally processed and converted into position data.

In the case where there are a plurality of dust removal parts, the corresponding position data thus converted can be successively stored in the memory 12 so as to continuously designate the positions thereby to successively carry out dust removing operations.

The position data are subjected to operational processing by the central processing unit CPU and thus converted into data, for example, pulse numbers, for controlling a driving motor, described hereinafter, of the dust removing mechanism 5, which data is transmitted through an interface I/F to the motor controller 13. On the basis of this data, the motor controller 13 controls the driving motors of the dust removing mechanism 5.

As shown in FIG. 2, the dust removal position inputting part 10 of the position inputting device 7 is in the form of a support table 15. This support table 15 is provided on a frame 17 supported on two pedestals 16. On the frame 17, at the back side thereof as viewed by the operator, a printed material feeding device 19 having feeding means such as feed rolls 19*a* is mounted, extending across the width of the frame 17 in the left-right direction. A sheet of printed material 18 with its leading edge clamped between the feed rolls 19*a* is laid flat on the support table 15. Then, when the feeding device 19 is operated, the printed material 18 is progressively sent toward the back over the surface of the support table 15. By appropriately stopping the feeding device 19, the printed material can be stopped at any desired position in the front-back direction. The feeding device 19 can be controllably operated by means such as a button 20.

Figure 4:
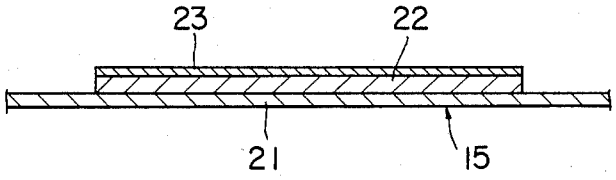
FIG. 4 is a fragmentary sectional view of a dust removal position inputting plate structure of laminated construction.

As shown in FIG. 4, the support table 15 of the dust removal position inputting part 10 has a plate structure formed, for example, by laminating sequentially from bottom to top a printed circuit substrate 21, a pressure-activated conductor sheet 22, and a protective sheet 23. A pressure-sensitive sheet manufactured under the brand name of PCR 101-05 by the Nippon Gosei-Gomu Kabushiki Kaisha (Japan Synthetic Rubber Co.) is suitable for use for the pressure-activated conductor sheet 22. Other examples of construction of the plate structure of the position inputting part 15 will be described hereinafter.

Figure 5:
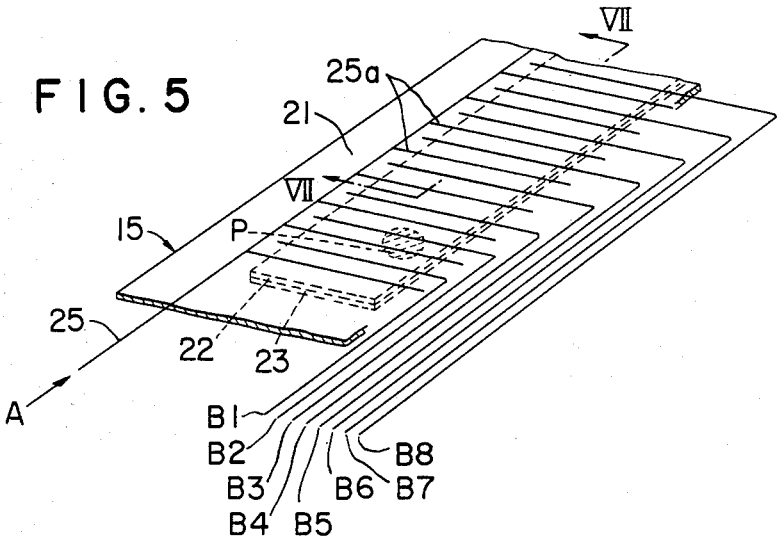
FIG. 5 is a schematic perspective view showing the back side of the plate structure shown in FIG. 4 and indicating the principle thereof.

As shown in FIG. 5, which is a fragmentary perspective view of the position inputting part 10 in inverted or upside-down state, the printed circuit substrate is provided with a comb-conductor circuit 25 into which is continually supplied a reference signal A with a certain sampling period from the aforementioned central processing unit CPU. The comb-conductor circuit 25 has a large number of parallel, spaced-apart comb conductors 25*a*, 25*a*, . . . commonly connected on one side. Between adjacent pairs of these comb conductors 25*a* are inserted, in parallel and spaced-apart relation thereto, terminal end conductors of respective position signal read-out circuits B1, B2, . . . B8, which are not in direct electrical contact with the conductors 25*a*, 25*a*, . . . . The spacing interval between each conductor 25*a* and an adjacent terminal end conductor of a signal read-out circuit is of the order of, for example, 2.5 mm.

When a printed material 18 (proof) is placed on the position inputting part 10 of the dust removal position inputting device 7 as indicated in FIG. 2, and an unprinted part thereof is pressed from above with a pen-like pressing tool (not shown), that portion of the pressure-activated conductor sheet 22 which has been thus pressed becomes electroconductive, whereby the circuit parts of the printed circuit substrate in the immediate vicinity thereof are electrically connected or shorted to close a circuit. For example, if a part P as shown in FIG. 5 is pressed, an input signal will be obtained from the port of the circuit B2. Accordingly, from the number of the port from which this signal was obtained and from the pitch of the circuit conductor lines the position in the left-right direction as viewed by the operator can be detected.

In the case where the signals are obtained from a plurality of ports, a datum of dust removal position can be obtained by determining the average value (intermediate position) of the input data.

The laminated plate construction of the position inputting part 10 may take forms other than that generally illustrated in FIG. 4. Some of such other examples are shown in FIGS. 7, 8 and 9, which also indicate respective modes of electric conductivity arising when a dust removal position is designated by the pressing P of a pressing tool against the position inputting part 10 over a printed material (proof).

Figure 7:
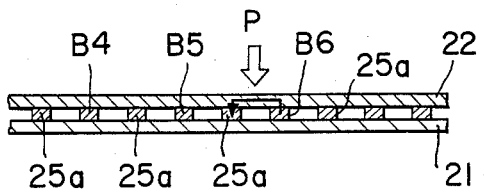
FIG. 7 is a fragmentary sectional view taken along the line VII—VII in FIG. 5 and showing an example of laminated construction of the dust removal position inputting plate structure which can be used in this invention.

The structure shown in FIG. 7, which corresponds to a section taken along the line VII—VII in FIG. 5, is of the basic construction comprising an underlying printed circuit substrate 21, a pressure-activated conductor sheet 22 serving as the uppermost layer, and comb conductors 25*a*, 25*a*, . . . and terminal end conductors of position signal read-out circuits B1, B2, . . . B8 interposed between the substrate 21 and the sheet 22. This construction is the same as that indicated in FIG. 4 except for the omission of the protective sheet 23. When a force P is applied at the dust removal position as described hereinbefore, the pressure-activated conductor sheet 22 becomes electroconductive in the region around this position, whereby a comb conductor 25*a* and an adjacent terminal end conductor B in the immediate vicinity are placed in electrical contact as indicated by the thick black arrow mark.

Figure 8:
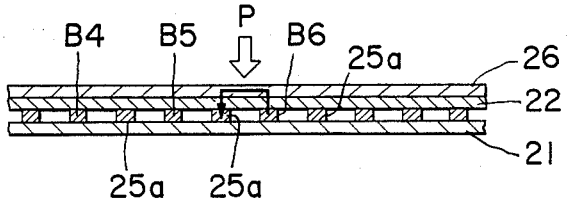
FIGS. 8 and 9 are fragmentary sectional views similar to FIG. 7, but showing respectively other different examples of laminated construction of the dust removal position inputting plate structure.

The structure illustrated in FIG. 8 has a construction similar to that of the structure shown in FIG. 7 with an additional metal foil constituting the uppermost layer 26. When a force P is applied at the dust removal position, the pressure-activated conductor sheet 22 becomes electroconductive in the region around this position as described above with reference to FIG. 7, but in this case, the electroconduction is principally through the portion of the metal foil 26 in this region since the ohmic resistance of the metal foil is the least. The electroconductivity of the pressure-activated conductor sheet 22 is more increased, when a force P is applied thereto, in the direction of thickness of the sheet than in the direction of the main surface thereof. The additional metal foil 26 functions as a main conductor in the direction along the main surface in place of the conductor sheet 22 of which the electro-conductivity in the same direction is not sufficient even when a force P is applied.

Figure 9:
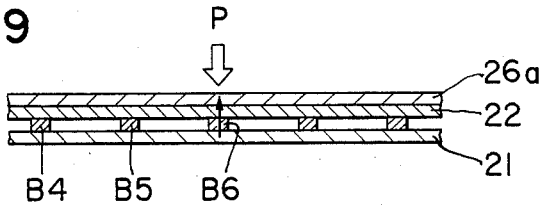

The structure shown in FIG. 9 has a construction similar to that in FIG. 8 except that only the terminal end conductors B1, B2, . . . B8 are interposed between the pressure-activated conductor sheet 22 and the printed circuit substrate 21, and the uppermost layer of the metal foil 26*a* is used as an output metal foil or an input metal foil. In this case, when the force P is applied as shown, the region of the pressure-activated conductor sheet 22 around the point of application of the force P becomes electroconductive, and the terminal end conductor nearest this point of force application is placed in electrical contact with the metal foil 26*a* as indicated.

Since the maximum size of a printed material is 880 mm×1,250 mm, which is large, in the case where an already installed color examination table 8 is to be used as the position inputting part, modification of the color examination table becomes necessary. By providing a printed material feeding device 19 as shown in FIG. 2, the position inputting part 10 of the inputting device 7 can be made small in its front-back direction.

Figure 6:
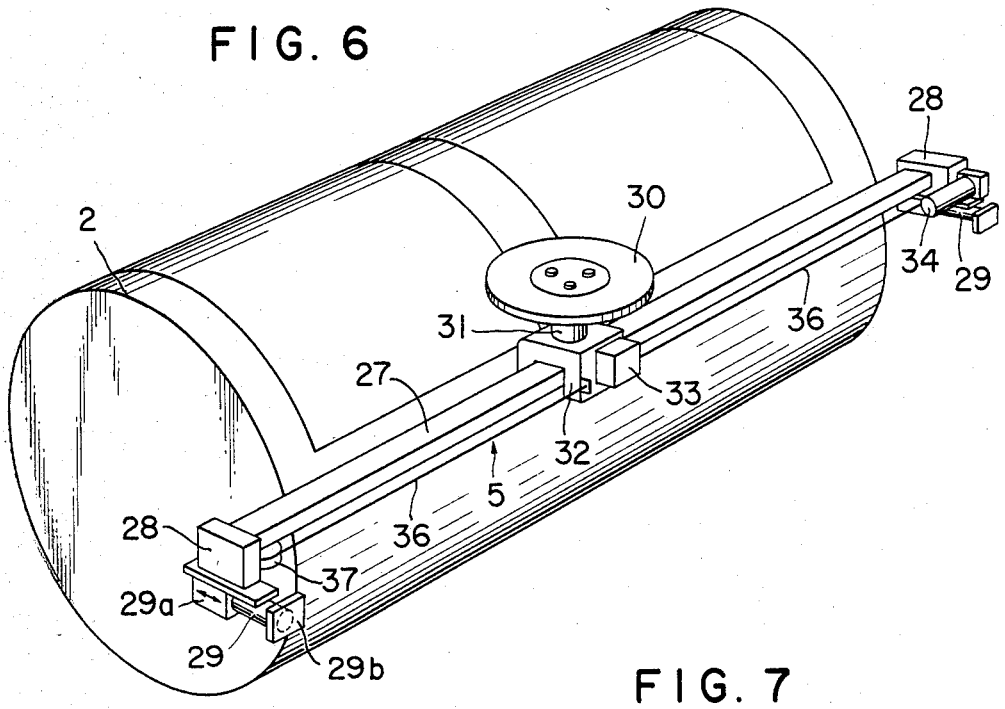
FIG. 6 is a perspective view showing a printing plate cylinder and a dust removing device of the invention and indicating the mechanism of dust removal according to the invention.

The dust removing mechanism 5 will now be described in greater detail with reference to FIG. 6.

This mechanism 5 has a guide rail 27 extending across the entire length of the plate cylinder 2 and supported at its opposite ends by support members 28. Each of the support members 28 is supported by a respective movable member 29*a* connected to one end of an air cylinder (or pneumatic actuator) 29 fixed at its other end to a fixed frame 29*b*. Each air cylinder 29 is horizontally orientated in a direction perpendicular to the guide rail 27. Thus the movable members 29*a* can be moved toward or away from the plate cylinder 2 by their air cylinders 29 thereby to move the guide rail 27 also toward and away from the plate cylinder 2.

A slide carriage 32 is slidably mounted on the guide rail 27 and rotatably supports a vertical rotating spindle 31, which is coupled by means such as a timing belt to a stepping motor 33. The spindle 31 at its upper end supports a dust removing head 30 co-axially fixed thereto. This dust removing head has a disk shape and is preferably made of an elastic material such as, for example, nitrile rubber (NBR). The slide carriage 32 is slidably movable along the guide rail 27 and can be thus driven by a head moving motor 34 fixedly mounted on the support member 28 at one end of the guide rail 27 through a movement transmitting member 36 such as a wire or a timing belt. The movement transmitting member 36 is passed around and supported by a pulley 37 rotatably supported at the other end of the guide rail 27.

When, as described hereinbefore, the position designation of the dust removal part of the printed material (proof) is carried out by pressing that part with the pressing tool at the dust removal position inputting part 10, the head moving motor 34 operates under control by the motor controller 13. The slide carriage 32 supporting the dust removing head 30 thereby moves accordingly along the guide rail 27 and stops at the position confronting the corresponding designated position on the plate cylinder 2.

Thereafter, the guide rail 27 is caused by the air cylinders 29 to advance toward the plate cylinder 2, and, as a consequence, one portion of the outer periphery of the dust removing head 30 is pressed against the surface of the plate cylinder 2. Since the plate cylinder 2 is rotating at this time, the problematic dust on the plate cylinder surface is removed by the relative movement between the dust removing head 30 and the plate cylinder 2.

After a specific contact time, the guide rail 27 is retracted from the plate cylinder 2 by the air cylinders 29, whereby the dust removing head 30 separates from the plate cylinder surface.

At the same time, the dust removing head 30 is revolved through a specific angle about its axis by the stepping motor 33 and is thus made ready for the succeeding dust removing operation. As a result of the revolving of the dust removing head 30 in this manner, the outer peripheral part of the head 30 to which the removed dust is adhering after removal is displaced to a position where it is not confronting the plate cylinder, whereby the head part confronting the plate cylinder is always maintained in a clean state in which no ink or dust is adhering thereto.

As a result of actual practice, it has been found that a satisfactory angular increment of the revolutional displacement of the dust removing head 30 is of the order of 5 degrees. Furthermore, the peripheral portion of the dust removing head 30 contacting the plate cylinder 2 during a succeeding dust removing action may partially overlap that peripheral portion of the head which has contacted the plate cylinder during the preceding dust removing action. It has also been found that, ordinarily, one dust removing head 30 can be used continuously for approximately 70 cycles of dust removing actions. Accordingly, only one operation of cleaning the dust removing head, which heretofore had to be carried out quickly, is sufficient in one day. Furthermore, after one dust removing head 30 has been used for one day, it can be replaced by another clean head and cleaned outside the printing press to be successively used.

What is claimed is:

1. A system for automatically removing dust from a plate cylinder of a printing press comprising:

a dust removing head mounted for displacement relative to and along the surface of a plate cylinder in the axial direction thereof of the printing press;

means for causing the dust removing head to advance toward and retract from the plate cylinder;

head moving means for causing the dust removing head to undergo said displacement to a position confronting any position on the plate cylinder surface;

dust removal position inputting means having a surface on which a printed matter is laid and having means which operates, when the position of a printing defect on the printed matter due to dust on the plate cylinder is pressed against said surface, to generate and transmit a position data signal corresponding to the position thus pressed with respect to the direction of the printed matter corresponding to the axial direction of the plate cylinder; and operationally processing means for converting said position data signal from the dust removal position inputting means into data for so controlling the head moving means that it moves the dust removing head to the position along the plate cylinder corresponding to said portion of the printing defect pressed against said surface.

2. A dust removing system according to claim 1 in which the dust removal position inputting means is constituted by a laminated plate structure comprising:

a printed circuit substrate bearing thereon a reference signal input circuit of comb form with a large number of parallel spaced-apart comb conductors and position signal read-out circuits having respective terminal end conductors respectively interposed in parallel and spaced-apart state between adjacent pairs of the comb conductors; and a pressure-activated conductor sheet superposed in laminated state on and over the printed circuit substrate.

3. A dust removing system according to claim 2 in which a protective sheet is further superposed in laminated state over the outer surface of the pressure-activated conductor sheet.

4. A dust removing system according to claim 2 in which a metal foil sheet is further superposed in laminated state on and over the outer surface of the pressure-activated conductor sheet.

5. A dust removing system according to claim 1 in which the dust removal position inputting means is constituted by a laminated plate structure comprising: a printed circuit substrate bearing thereon terminal end conductors of respective position signal read-out circuits, said terminal end conductors being in parallel spaced-apart arrangement; a pressure-activated conductor sheet superposed in laminated state on and over the printed circuit substrate; and a metal foil sheet superposed in laminated state on and over the outer surface of the pressure-activated conductor sheet.

6. A dust removing system according to claim 1 in which the operationally processing means has a central processing unit connected through respective interfaces to the dust removal position inputting means, display means and motor controller means and memory means, the central processing unit receiving, as input, dust removal position data from the dust removal position inputting means and processing this data to convert the same into position data for operating the motor controller means in response to this data, the motor controller means operating accordingly to controllably operate the head moving means, the memory means serving to successively store converted position data for subsequent dust removing operations in the case where a plurality of dust removal positions are designated.

7. A dust removing system according to claim 1 in which the dust removing head comprises essentially a disk member rotatably supported in such a manner that any one portion of the outer periphery thereof can contact the plate cylinder surface when the dust removing head is advanced toward the plate cylinder by said means or causing the head to advance, and means for causing the disk member to undergo revolution about its axis through small increments of angle.

8. A dust removing system according to claim 7 in which the disk member is made of an elastic material.

* * * * *